US007839202B2

(12) United States Patent
Sengupta et al.

(10) Patent No.: US 7,839,202 B2
(45) Date of Patent: Nov. 23, 2010

(54) BANDGAP REFERENCE CIRCUIT WITH REDUCED POWER CONSUMPTION

(75) Inventors: Susanta Sengupta, Leander, TX (US); Kenneth Charles Barnett, Austin, TX (US); Yunfei Feng, Austin, TX (US)

(73) Assignee: QUALCOMM, Incorporated, San Diego, CA (US)

( * ) Notice: Subject to any disclaimer, the term of this patent is extended or adjusted under 35 U.S.C. 154(b) by 107 days.

(21) Appl. No.: 11/866,120

(22) Filed: Oct. 2, 2007

(65) Prior Publication Data

US 2009/0085549 A1 Apr. 2, 2009

(51) Int. Cl.
*G05F 1/10* (2006.01)

(52) U.S. Cl. ..... 327/539

(58) Field of Classification Search ..... 327/539–541, 327/543, 544; 323/313
See application file for complete search history.

(56) References Cited

U.S. PATENT DOCUMENTS

| | | | | |
|---|---|---|---|---|
| 6,031,365 | A | 2/2000 | Sharpe-Geisler | |
| 6,680,643 | B2 * | 1/2004 | Conte et al. | 327/539 |
| 6,894,555 | B2 * | 5/2005 | Liu | 327/539 |
| 6,930,537 | B1 * | 8/2005 | Ceekala et al. | 327/539 |
| 7,078,958 | B2 * | 7/2006 | Gower et al. | 327/539 |
| 7,514,987 | B2 * | 4/2009 | Lin | 327/539 |
| 7,535,285 | B2 * | 5/2009 | Colman | 327/539 |
| 2003/0076157 | A1 | 4/2003 | Shu | |
| 2007/0105576 | A1 | 5/2007 | Gupta et al. | |

FOREIGN PATENT DOCUMENTS

| | | | |
|---|---|---|---|
| EP | 0131340 | A1 | 1/1985 |
| JP | 2007311448 | | 11/2007 |
| WO | WO02082751 | A2 | 10/2002 |
| WO | WO03101134 | | 12/2003 |
| WO | WO2005109673 | | 11/2005 |
| WO | WO2007059448 | | 5/2007 |

OTHER PUBLICATIONS

International Search Report and Written Opinion - PCT/US2008/078509, International Search Authority - European Patent Office - Feb. 10, 2009 (071362).

Ion E Opris: "Series Resistance Compensation in Translinear Circuits " IEEE Transactions on Circuits and Systems Part I: Regular Papers, IEEE Service Center, New York, NY, US, vol. 45, No. 1, Jan. 1, 1998, XP011011675.

* cited by examiner

*Primary Examiner*—Hai L Nguyen
(74) *Attorney, Agent, or Firm*—William M. Hooks

(57) ABSTRACT

A bandgap voltage reference circuit and methods for generating a bandgap reference voltage are disclosed. An operational amplifier receives first and second input voltages from a first and second current path, respectively. A buffer stage is coupled to an output of the operational amplifier and generates third and fourth voltages on the first and second path. A temperature dependent current is generated using the third and fourth voltages in combination with a first diode, second diode and a resistor. A third current path mirrors the temperature dependent current and a temperature independent voltage is generated for the bandgap reference voltage in the third current path using the temperature dependent current in combination with a second resistor and related diode.

18 Claims, 5 Drawing Sheets

BANDGAP REFERENCE CIRCUIT WITH REDUCED POWER CONSUMPTION

BACKGROUND OF THE INVENTION

1. Field of the Invention

The invention relates generally to bandgap reference circuits, and more particularly to bandgap reference circuits with reduced power consumption.

2. Description of the Related Art

One of the essential building blocks of many analog circuits is a voltage reference, which is configured to exhibit little dependence on supply and process parameters and a well-defined dependence on temperature. Accurate biasing voltages are critical for many circuit schemes. For example, in an analog-to-digital converter (ADC), a reference voltage is required to accurately quantify an input, while in a digital-to-analog converter (DAC), the reference voltage is required to define the output full-scale range.

Bandgap reference circuits are conventionally used to maintain the voltage reference at a predetermined level. The general principle of bandgap reference circuits relies on two diode-connected BJT transistors (or junction diodes 105 and 110 as illustrated in FIG. 1) running at different emitter current densities. By canceling the negative temperature dependence of the PN junctions in one group of transistors with the positive temperature dependence from a proportional-to-absolute-temperature (PTAT) circuit which includes the other group of transistors, a fixed DC voltage that does not change substantially with temperature is generated.

FIG. 1 illustrates a conventional bandgap reference circuit 100. Referring to FIG. 1, the bandgap reference circuit 100 includes PMOS transistors M1, M2 and M3, an operational amplifier 105, resistors R and kR, and diodes 110, 115 and 120. The operational amplifier 105 functions to equate the voltages V1 and V2 and generate a PTAT voltage across the resistor R, as shown in FIG. 1. The output of operational amplifier 105 drives the gates of transistors M1, M2 and M3, to generate the current I_ptat having a positive temperature dependence, due to the different current densities in the PN junctions of diodes 110, and 115. The positive temperature dependence of I_ptat can be used with the negative temperature dependence of the PN junction of diode 120 to generate the temperature independent bandgap reference voltage (Vbg), as is known in the art.

If the operational amplifier 105 was an ideal component V1 would equal V2. However, the operational amplifier 105 also amplifies the input-referred noise to the output voltage, or bandgap voltage Vbg. Likewise, similar to the input-referred noise, the input-referred offset voltage of the operational amplifier 105 also gets amplified and affects the bandgap voltage Vbg.

Generally, in the bandgap reference circuit 100 of FIG. 1, the burden of maintaining the low overall amount of noise in the bandgap voltage Vbg is placed on the operational amplifier 105. Thus, the operational amplifier consumes a relatively high amount of power in order to maintain noise at acceptable levels.

Ideally, the output voltage of a bandgap reference circuit should be substantially constant irrespective of Process, Voltage, and Temperature (PVT) variations. As discussed above, bandgap reference circuit design conventionally focuses mainly on temperature compensation. However, process variations may have the biggest impact on the absolute value of the reference voltage. For example, in the circuit illustrated in FIG. 1, the input offset voltage of the operational amplifier 105 may vary considerably due to process variations in the material and manufacture that are present in any large scale production of integrated circuits (e.g., millions of units). As noted above, this input offset voltage gets amplified and will create an error in the bandgap voltage Vbg.

SUMMARY OF THE INVENTION

Embodiments of the invention are directed to bandgap voltage reference circuits and methods for generating bandgap voltages with reduced power consumption.

Accordingly, an embodiment of the invention can include a bandgap voltage reference circuit comprising: first, second, and third current paths configured to substantially mirror each other; an operational amplifier having inputs coupled to a first voltage node on the first current path and a second voltage node on the second current path; a first transistor coupled in series with the first current path between the first voltage node and a third voltage node; a second transistor coupled in series with the second current path between the second voltage node and a fourth voltage node, wherein gates of the first and second transistors are coupled to an output of the operational amplifier, and wherein the first and second transistors are configured to generate a temperature dependent current in the first, second, and third current paths.

Another embodiment of the invention can include a bandgap voltage reference circuit comprising: an operational amplifier coupled to a first voltage node on a first current path and a second voltage node on a second current path, wherein the first and second current paths are configured to substantially mirror each other; a buffer stage coupled to an output of the operational amplifier configured to generate a third voltage on the first current path and a fourth voltage on the second current path; a first diode coupled in series in the first current path; a second diode and a resistor coupled in series in the second current path, wherein a temperature dependent current is generated using the third and fourth voltages in combination with the first diode, second diode and resistor; and a third current path configured to substantially mirror the temperature dependent current in the first and second current paths, wherein a temperature independent voltage is generated at a bandgap reference node in the third current path using the temperature dependent current.

Another embodiment of the invention can include a method for generating a bandgap reference voltage comprising: inputting a first voltage from a first node in a first current path and a second voltage from a second node in a second current path to an operational amplifier; buffering an output of the operational amplifier to generate a third voltage at a third node on the first current path and a fourth voltage at a fourth node on the second current path; generating a temperature dependent current using the third and fourth voltages; mirroring the temperature dependent current in the first current path, the second current path and a third current path; and generating at a bandgap reference voltage node a temperature independent voltage in the third current path using the temperature dependent current.

BRIEF DESCRIPTION OF THE DRAWINGS

A more complete appreciation of embodiments of the invention and many of the attendant advantages thereof will be readily obtained as the same becomes better understood by reference to the following detailed description when considered in connection with the accompanying drawings which are presented solely for illustration and not limitation of the invention, and in which.

DETAILED DESCRIPTION

Aspects of the invention are disclosed in the following description and related drawings directed to specific embodiments of the invention. Alternate embodiments may be devised without departing from the scope of the invention. Additionally, well-known elements of the invention will not be described in detail or will be omitted so as not to obscure the relevant details of the invention.

The words "exemplary" and/or "example" are used herein to mean "serving as an example, instance, or illustration." Any embodiment described herein as "exemplary" and/or "example" is not necessarily to be construed as preferred or advantageous over other embodiments. Likewise, the term "embodiments of the invention" does not require that all embodiments of the invention include the discussed features, functionalities or modes of operation.

Figure 1:
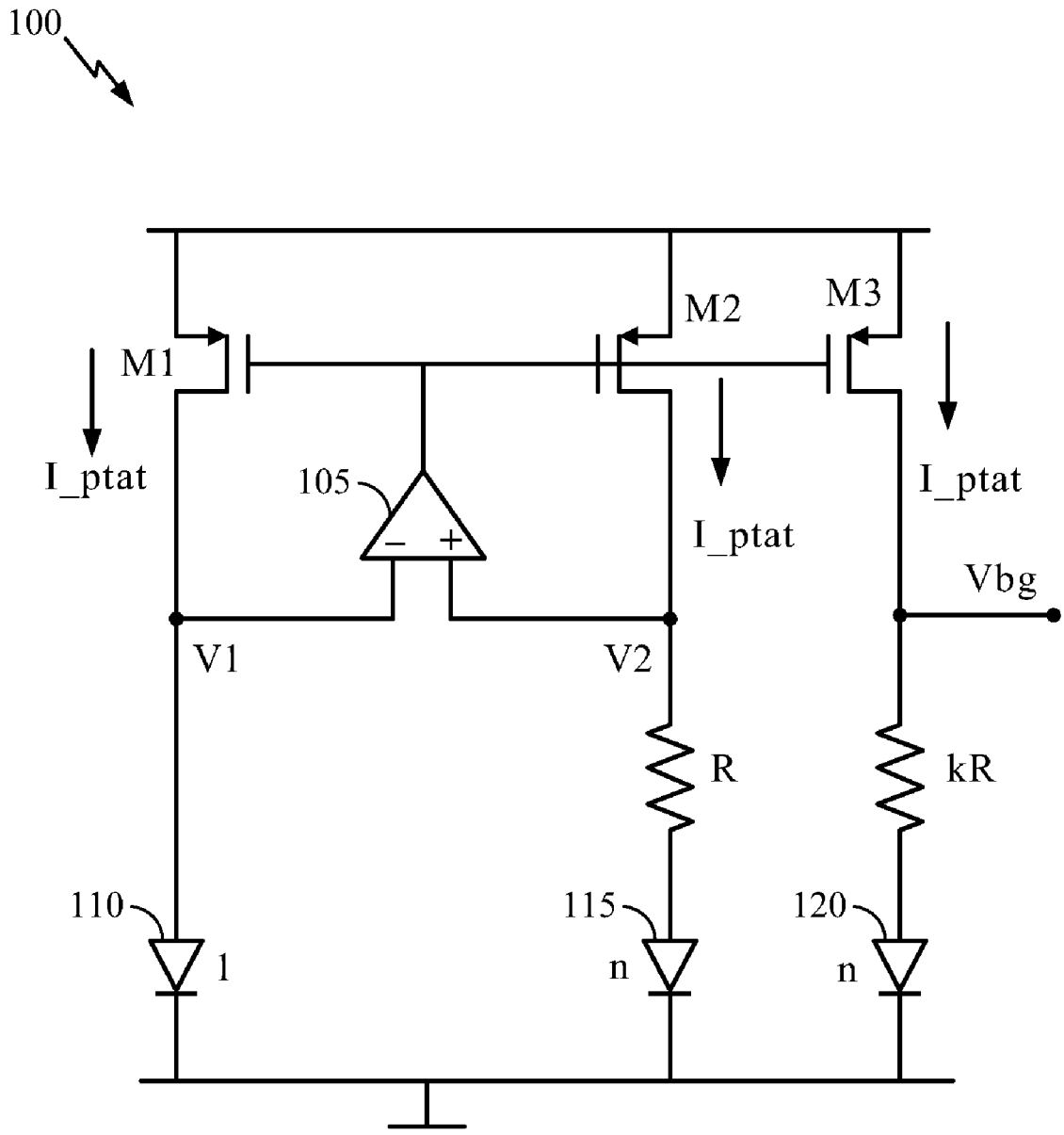
FIG. 1 (PRIOR ART)
FIG. 1 is an illustration of a schematic diagram of a conventional bandgap reference circuit.
Figure 2:
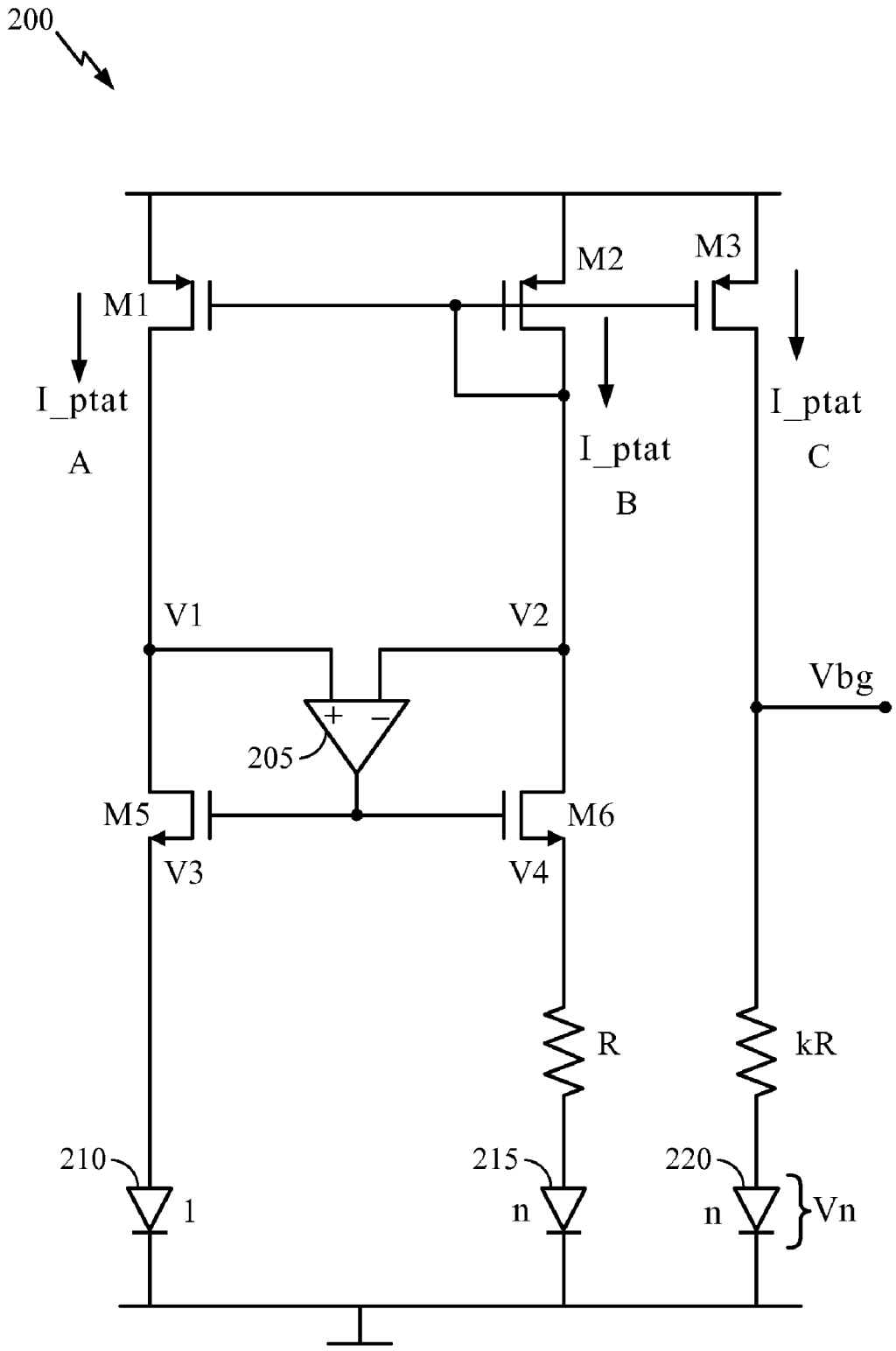
FIG. 2 is an illustration of a schematic diagram of a bandgap reference circuit.

FIG. 2 illustrates a bandgap reference circuit 200 according to an embodiment of the present invention. As shown in FIG. 2, the bandgap reference circuit 200 includes PMOS transistor M3, resistors R and kR and diodes 210, 215 and 220, which generally correspond in functionality to their like-numbered and like-labeled counterpart elements from FIG. 1. Accordingly, further description of these elements will be omitted for the sake of brevity.

Referring to FIG. 2, the bandgap reference circuit 200 further includes PMOS transistors M1, M2, and NMOS transistors M5, and M6, and operational amplifier 205. Once again, the input-referred noise of the operational amplifier 205 occurs at nodes V1 and V2, similar to nodes V1 and V2 of FIG. 1. However, because of the gain introduced at the respective NMOS transistors M5 and M6, the level of the noise voltage at V3 and V4 nodes is at a lower level than the noise level at V1 and V2. This reduces the overall noise contribution of the operational amplifier 205 to the bandgap reference voltage Vbg. Likewise, the effect of the input offset voltage of operational amplifier 205 is reduced due to the gain of NMOS transistors M5 and M6. Accordingly, any variation in the input offset voltage of the operational amplifiers due to the process variations will be scaled by the gain of transistors M5 and M6.

Thus, a lower power amplifier may be selected as the operational amplifier 205, as compared to the operational amplifier 105 of FIG. 1. Likewise, a greater degree of process variation and related variation in the input offset voltage of the operational amplifiers can be tolerated, as compared to the conventional design. The above-described power consumption benefits of the bandgap reference circuit 200 of FIG. 2 are achieved without compromising the power supply rejection ratio (PSRR) characteristics and/or temperature behavior of the bandgap reference voltage Vbg, when compared to the conventional design.

As shown in FIG. 2, transistors M1, M2 and M3 are arranged in a current mirror configuration. The operational amplifier 205 functions to equate the voltages V1 and V2 and generate a PTAT voltage across the resistor R. However, as discussed in the foregoing design, the output of operational amplifier 205 drives transistors M5 and M6, which actually generates PTAT voltage across the resistor R and correspondingly the current (I_ptat). This current, I_ptat, is mirrored in paths A, B and C as indicated in FIG. 2, by operation of the current mirror configuration of transistors M1, M2 and M3. It will be appreciated that transistors M1 or M2 do not control the current (I_ptat), but merely serve to help maintain balance between the paths. The current is controlled by the output of the operational amplifier 205 and transistors M5 and M6 along with diodes 210, 215 and R. Transistors M5 and M6 tend to isolate nodes V3 and V4 from the noise and the input offset voltage at nodes V1 and V2, due to the gain of these transistors, as discussed above. Accordingly, the current I_ptat will be generated based on V3 and V4. Since I_ptat is mirrored in path C through transistor M3, and the bandgap reference voltage (Vbg) is generated based on I_ptat and kR, the bandgap reference voltage will have lower noise and voltage variation.

Once again, the current I_ptat has a positive temperature dependence, due to the different current densities in the PN junctions of diodes 210 and 215. The positive temperature dependence of I_ptat can be used with the negative temperature dependence of the PN junction of diode 220 (which matches the characteristics of diode 215) and the appropriate selection of factor k, to generate the temperature independent bandgap reference voltage (Vbg), as is known in the art. Specifically, the bandgap reference voltage (Vbg) is generated as Vbg=I_ptat*kR+Vn, where Vn is the drop across diode 220.

Accordingly, an embodiment of the invention can include a bandgap voltage reference circuit having first, second, and third current paths (e.g., A, B and C) configured to substantially mirror each other. An operational amplifier 205 can have inputs coupled to a first voltage node (e.g., at V1) on the first current path A and a second voltage node (e.g., at V2) on the second current path B. A first transistor M5 can be coupled in series in the first current path A between the first voltage node and a third voltage node (e.g., at V3). A second transistor M6 can be coupled in series in the second current path B between the second voltage node and a fourth voltage node (e.g., at V4). The gates of the first M5 and second M6 transistors can be coupled to an output of the operational amplifier 205. The first M5 and second M6 transistors can be configured to generate a temperature dependent current (I_ptat) in the first A, second B, and third C current paths, as discussed in the foregoing in combination with diodes 210, 215 and resistor R.

Embodiments of the invention can also include a bandgap voltage reference circuit having an operational amplifier 205 coupled to a first voltage node (e.g., at V1) on a first current path A and a second voltage node (e.g., at V2) on a second current path B. The first A and second B current paths are configured to substantially mirror each other (e.g., via M1 and M2). A buffer stage (e.g., M5 and M6) can be coupled to an output of the operational amplifier 205. However, the buffer stage can be any device or devices that can be configured to generate a third voltage V3 on the first path A and a fourth voltage V4 on the second path B. Specifically, the buffer stage has a gain increase that amplifies the voltage output of operational amplifier 205, which reduces the current consumption and noise as discussed above. A first diode 210 can be coupled in series in the first current path A. A second diode 215 and a resistor 220 can be coupled in series in the second current path B. A temperature dependent current (I_ptat) can be generated using the third V3 and fourth V4 voltages in combination with the first diode 210, second diode 215 and resistor R. A third current path C can be configured to substantially mirror (e.g., via M1-M3) the temperature dependent current I_ptat in the first A and second B current paths. A temperature independent voltage (Vbg) can be generated at a bandgap reference node in the third current path C using the temperature dependent current.

Figure 3:
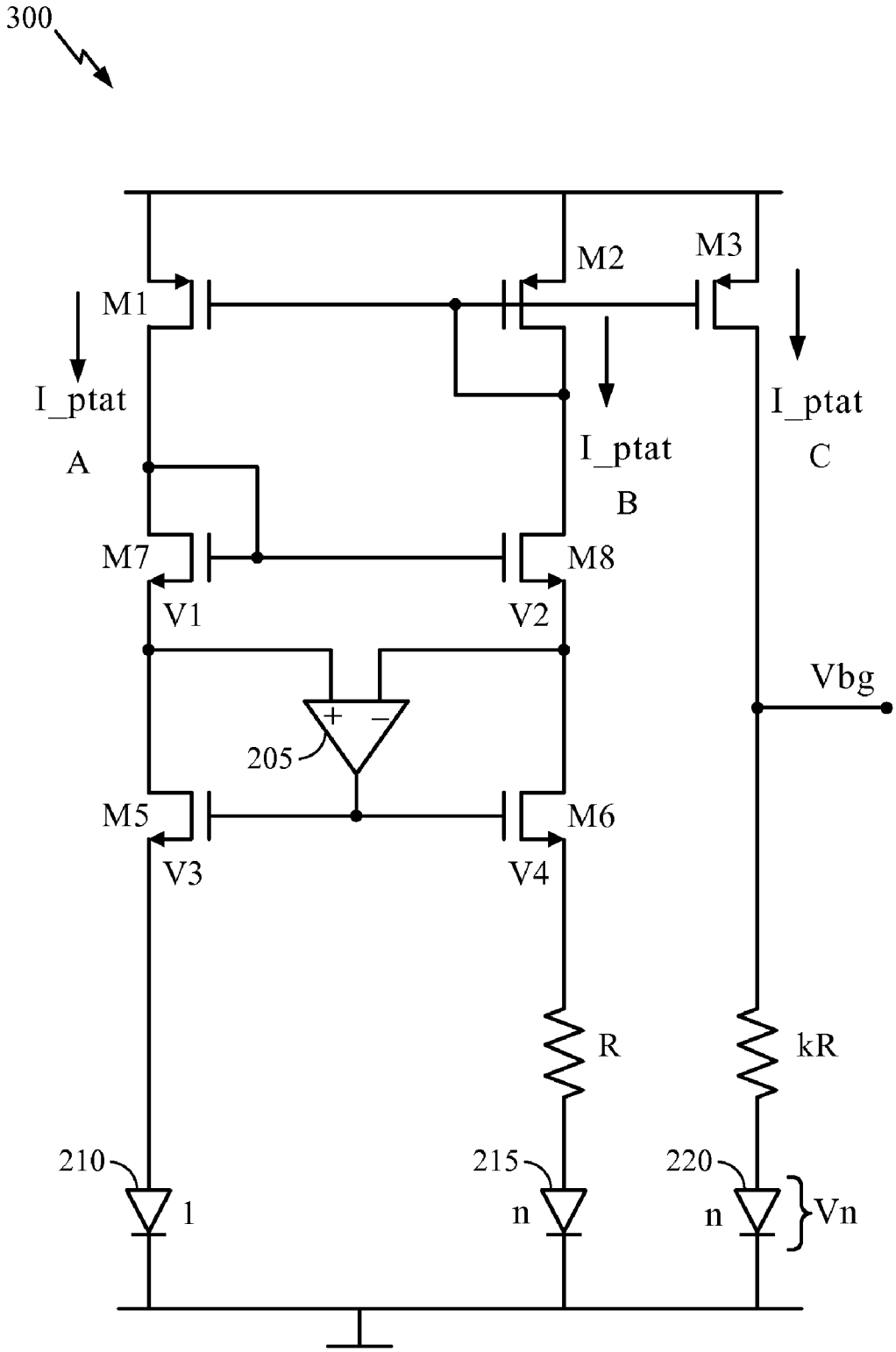
FIG. 3 is an illustration of a schematic diagram of another configuration of a bandgap reference circuit.

An alternative embodiment of the bandgap reference circuit 300 is illustrated in FIG. 3. Since the operation and configuration of the bandgap reference circuit 300 is similar to bandgap reference circuit 200 described above, only the relevant changes will be discussed. The bandgap reference circuit 300, in comparison to bandgap reference circuit 200, further includes NMOS transistors M7 and M8. Generally, transistors M7 and M8 are used to increase the impedance (e.g., looking down path A or B) of the bandgap reference circuit 300, and do not change the basic operation of the bandgap reference circuit 300. Since transistors M7 and M8 are arranged in series with M1 and M2, respectively, and are connected as current mirror, they will merely pass the current I_ptat. Transistors M7 and M8 can also help to improve the power supply rejection ratio (PSRR) characteristics. The impedance of the bandgap reference circuit may thereby be controlled by a system designer by either including or excluding the NMOS transistors M7 and M8.

Figure 4:
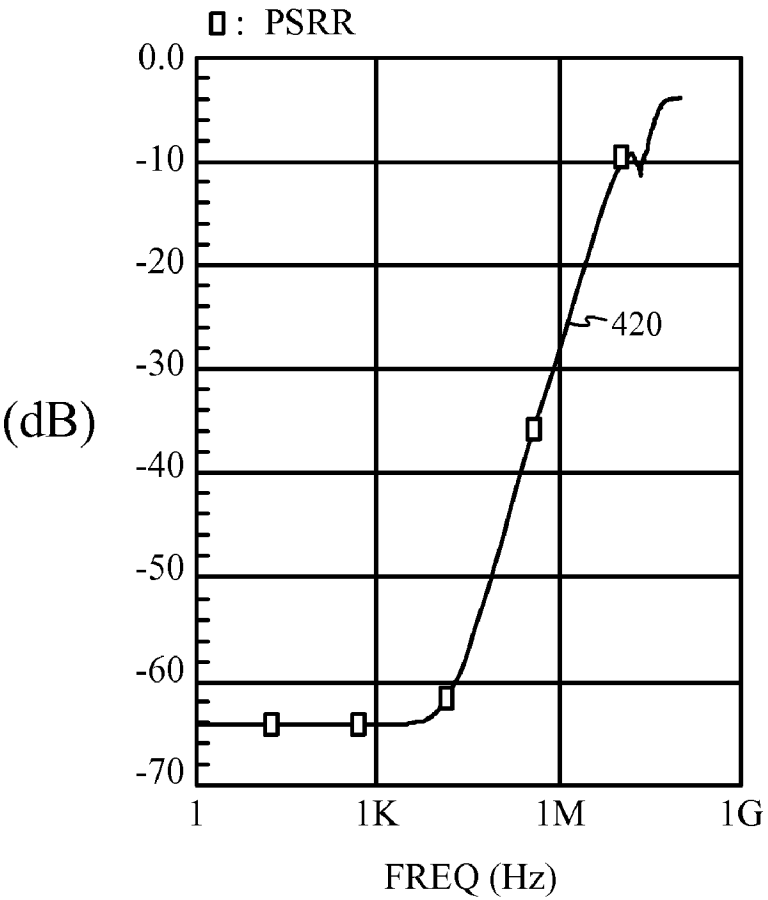
FIG. 4 illustrate graphs generated from a simulation of the output of the bandgap reference circuit of FIG. 3.
Figure 4:
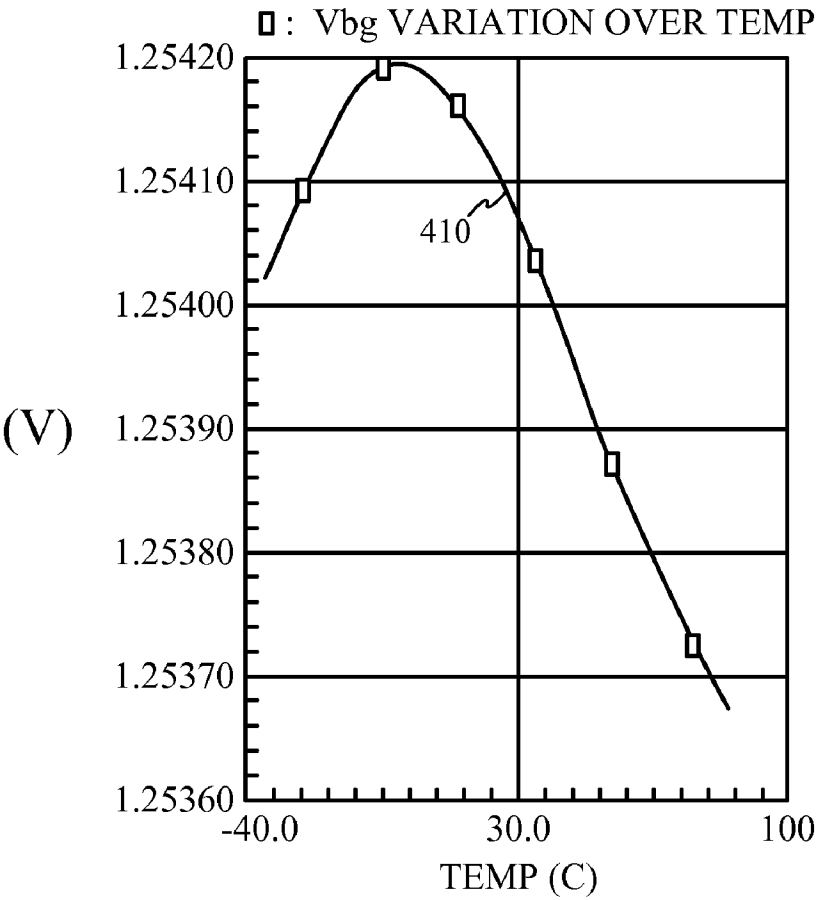

FIG. 4 illustrates graphs of the bandgap reference voltage variation over temperature and power supply rejection ratio (PSRR) characteristics of circuit 300. The graphs were generated via simulation and FIG. 4 is a screen capture of the output of the simulation. However, the result of the simulation was confirmed by actual testing of prototype circuits. The left graph in FIG. 4 plots the bandgap reference voltage variation 410 over temperature. Specifically, as illustrated the bandgap reference voltage 410 varied less than 0.0060 volts (graph scaled from 1.25360 to 1.25420 volts) over a temperature range of approximately −40 to 100 degrees Celsius. In the right graph, the power supply rejection ratio (PSRR) 420 is plotted in terms of dB and frequency. As illustrated, the PSRR varied from about −65 dB at 1 Hz to about −5 dB at 500 MHz.

The noise contribution in a bandgap reference circuit can be problematic for low noise applications, such as a voltage controlled oscillator (VCO). When used in a VCO, any noise generated by the bandgap reference circuit will add to the phase noise of the VCO. It will be appreciated that noise is a critical factor in VCOs and noise generate by the bandgap reference circuit will impact the performance of the VCO, particularly for high frequency applications. Accordingly, as discussed above, embodiments of the invention can improve the noise performance of the bandgap reference circuit using a lower power design, which can improve the performance in related circuits, such as VCOs.

Figure 5:
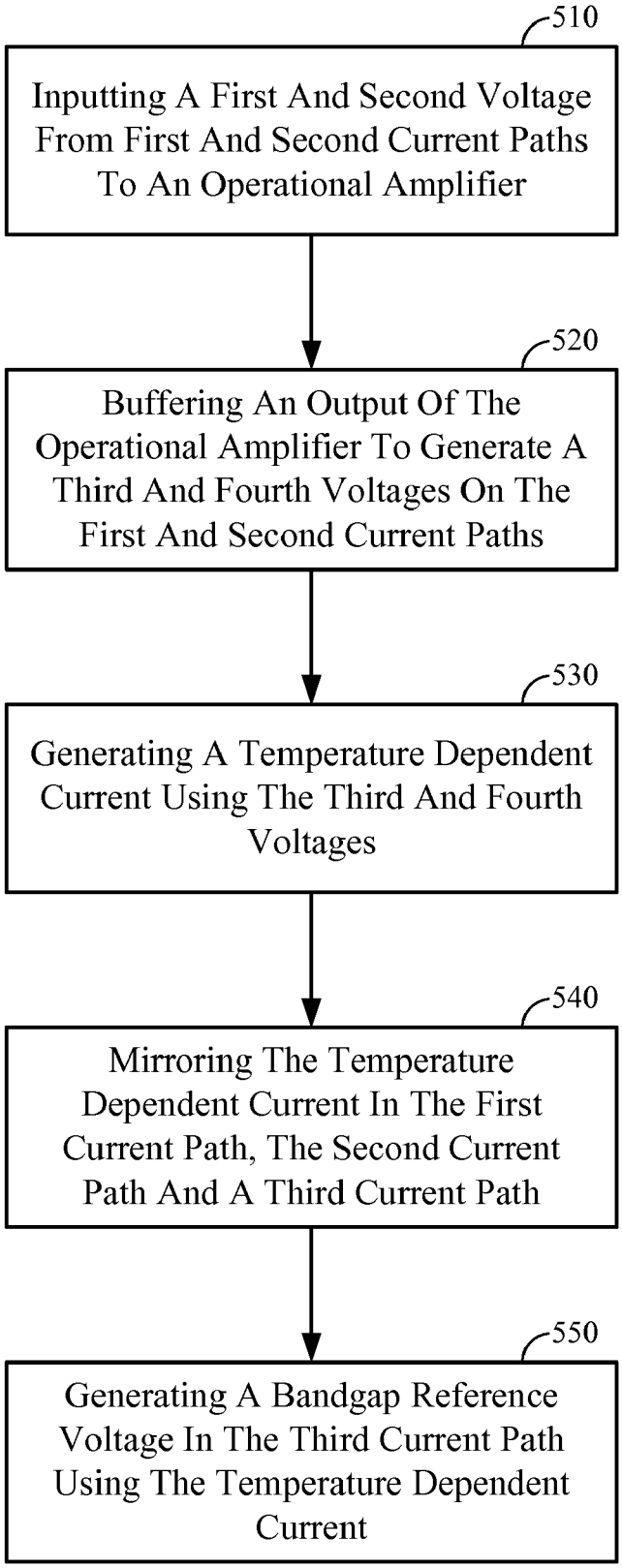
FIG. 5 illustrates a method for generating bandgap reference voltages.

In view of the foregoing disclosure, it will be appreciated that embodiments of the invention can include methods for generating a bandgap reference voltage. Accordingly, referring to FIG. 5, a method for generating a bandgap reference voltage can include inputting a first voltage from a first node in a first current path and a second voltage from a second node in a second current path to an operational amplifier, 510. An output of the operational amplifier can be buffered to generate a third voltage at a third node on the first current path and a fourth voltage at a fourth node on the second current path, 520. A temperature dependent current can be generated using the third and fourth voltages, 530 (e.g., as discussed above in combination with diodes 210, 215 and resistor R). The temperature dependent current can be mirrored in the first current path, the second current path and a third current path, 540. The bandgap reference voltage (a temperature independent voltage) can then be generated in the third current path using the temperature dependent current, 550 (e.g., as discussed above in relation to kR and diode 220). The methods are not limited to this illustration and further embodiments can include additional steps and/or sequence of actions as can be ascertained from the foregoing disclosure.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

What is claimed is:

1. A bandgap voltage reference circuit comprising:

first, second, and third current paths configured to substantially mirror each other;

an operational amplifier having inputs coupled to a first voltage node on the first current path and a second voltage node on the second current path;

a first transistor coupled in series with the first current path between the first voltage node and a third voltage node; and a second transistor coupled in series with the second current path between the second voltage node and a fourth voltage node, wherein gates of the first and second transistors are coupled to an output of the operational amplifier, and wherein the first and second transistors are configured to generate a temperature dependent current in the first, second, and third current paths.

2. The circuit of claim 1, further comprising:

third, fourth and fifth transistors each coupled in one of the first, second, and third current paths, wherein the third, fourth and fifth transistors are arranged in a current mirror configuration.

3. The circuit of claim 2, wherein the first and second transistors are NMOS transistors and wherein the third, fourth and fifth transistors are PMOS transistors.

4. The circuit of claim 2, further comprising:

a first diode coupled in series in the first current path between the third voltage node and a ground; and a second diode coupled in series in the second current path between the ground and a first resistance coupled to the fourth voltage node.

5. The circuit of claim 4, further comprising:

a third diode coupled in series in the third current path between the ground and a second resistance coupled to a bandgap reference voltage.

6. The circuit of claim 2, further comprising:

a sixth transistor coupled between the third transistor and the first voltage node; and a seventh transistor coupled between the fourth transistor and the second voltage node, wherein the sixth and seventh transistors are arranged in a current mirror configuration.

7. The circuit of claim 6, wherein the sixth and seventh transistors are NMOS transistors.

8. The circuit of claim 6, further comprising:

a first diode coupled in series in the first current path between the third voltage node and a ground; and a second diode coupled in series in the second current path between the ground and a first resistance coupled to the fourth voltage node.

9. The circuit of claim 6, further comprising:

a third diode coupled in series in the third current path between the ground and a second resistance coupled to a bandgap reference voltage.

10. A bandgap voltage reference circuit comprising:

an operational amplifier coupled to a first voltage node on a first current path and a second voltage node on a second current path, wherein the first and second current paths are configured to substantially mirror each other;

a buffer stage coupled to an output of the operational amplifier configured to generate a third voltage on the first current path and a fourth voltage on the second current path, wherein the buffer stage comprises: a first transistor coupled in series in the first current path between the first voltage node and the third voltage node; and a second transistor coupled in series in the second current path between the second voltage node and the fourth voltage node;

a first diode couple in series in the first current path;

a second diode and a resistor coupled in series in the second current path, wherein a temperature dependent current is generated using the third and fourth voltages in combination with the first diode, second diode and resistor; and a third current path configured to substantially mirror the temperature dependent current in the first and second current paths, wherein a temperature independent voltage is generated at a bandgap reference node in the third current path using the temperature dependent current.

11. The circuit of claim 10, further comprising:

a third diode coupled in series in the third current path between a ground and a second resistance coupled to the bandgap reference voltage node.

12. The circuit of claim 10, further comprising:

third, fourth and fifth transistors each coupled in one of the first, second, and third current paths, wherein the third, fourth and fifth transistors are arranged in a current mirror configuration.

13. The circuit of claim 12, wherein the first and second transistors are NMOS transistors and wherein the third, fourth and fifth transistors are PMOS transistors.

14. The circuit of claim 12, further comprising:

a sixth transistor coupled between the third transistor and the first voltage node; and a seventh transistor coupled between the fourth transistor and the second voltage node, wherein the sixth and seventh transistors are arranged in a current mirror configuration.

15. A method for generating a bandgap reference voltage comprising:

inputting a first voltage from a first node in a first current path and a second voltage from a second node in a second current path to an operational amplifier;

buffering an output of the operational amplifier to generate a third voltage at a third node on the first current path and a fourth voltage at a fourth node on the second current path, wherein buffering the output of the operational amplifier is performed by a first transistor coupled in series in the first current path between the first node and the third node; and a second transistor coupled in series in the second current path between the second node and the fourth node;

generating a temperature dependent current using the third and fourth voltages;

mirroring the temperature dependent current in the first current path, the second current path and a third current path; and generating at a bandgap reference voltage node a temperature independent voltage in the third current path using the temperature dependent current.

16. The method of claim 15, wherein the temperature independent voltage is generated by a third diode coupled in series in the third current path between a ground and a second resistance coupled to the bandgap reference voltage node.

17. The method of claim 16, wherein mirroring the temperature dependent current is performed by third, fourth and fifth transistors each coupled in one of the first, second, and third current paths.

18. The method of claim 17, further comprising:

providing a sixth transistor coupled between the third transistor and the first node and a seventh transistor coupled between the fourth transistor and the second node, wherein the sixth and seventh transistors are arranged in a current mirror configuration.

* * * * *